United States Patent [19]

Lichtblau

[11] 3,961,322

[45] *June 1, 1976

[54] REAL TIME SIGNAL DISCRIMINATION CIRCUITRY

[76] Inventor: George Jay Lichtblau, 425 E. 63rd St. Suite E-12-D, New York, N.Y. 10021

[ * ] Notice: The portion of the term of this patent subsequent to Jan. 28, 1992, has been disclaimed.

[22] Filed: July 2, 1974

[21] Appl. No.: 485,206

[52] U.S. Cl. ..... 340/280; 340/152 T

[51] Int. Cl.[2] ..... G08B 13/00; G08B 21/00

[58] Field of Search ..... 328/108, 111, 112, 129, 328/167; 340/224, 280, 258 A, 258 C, 152 T; 343/6.555; 307/234, 235

[56] References Cited

UNITED STATES PATENTS 3,863,244 1/1975 Lichtblau ..... 340/280

*Primary Examiner*—Harold I. Pitts

*Attorney, Agent, or Firm*—Weingarten, Maxham & Schurgin

[57] ABSTRACT

Real time signal detection circuitry suitable for detection of a resonant tag such as in an electronic security system. True received signals are detected in the presence of high background noise by application of the received signal to a series of pulse height and width threshold detectors which are enabled in a desired sequence. Detection of a series of pulse components comprising an expected signal waveform, having predetermined height and width and occurring in a desired sequence and time relationship provides an alarm indication. A plurality of parallel filters may receive the input signal to produce different waveform configurations for parallel coincidence processing. The circuitry of the invention provides extremely sharp signal discrimination without the use of video delay lines such as used in cross-correlation systems and enables non-repetitive signals to be detected in real time with great accuracy.

8 Claims, 11 Drawing Figures

32
33
T 34
35
36
T 34
35
41
45
43
36
T 41
45
H1
H3
43
W1
T1
H2
T2
W3
W2
T 60
62
64
T

67
T

66
T 66
54
COUNTER (÷ M)
56
DECODER
58
OR GATES
$E_n$
$E_1$ $E_2$ $E_3$
52
MONOSTABLE MULTIVIBRATOR
50
OR GATE
46
38
PDM-1
PDM-2
PDM-3
PDM-N
$E_1$
$E_2$
$E_3$
INPUT
48
$E_n$ 80
76
78
COUNTER (÷P)
DECODER
$E_a$ $E_b$ $E_c$ E
74
MONOSTABLE MULTIVIBRATOR
72
OR GATE
82
TIME DELAY $T_a$
TIME DELAY $T_b$
TIME DELAY $T_c$
TIME DELAY $T_n$
46
SIGNAL PROCESSING SPM-1 MODULE
SIGNAL PROCESSING SPM-2 MODULE
SIGNAL PROCESSING SPM-3 MODULE
SIGNAL PROCESSING SPM-n MODULE
81
AMP
80
$F_1$
$F_2$
$F_3$
$F_n$
68
$E_a$
$E_b$
$E_c$
INPUT
71
$E_n$

REAL TIME SIGNAL DISCRIMINATION CIRCUITRY

FIELD OF THE INVENTION

This invention relates to signal detection circuitry and more particularly to circuitry for the reliable real time detection of an expected signal in the presence of a high noise background.

BACKGROUND OF THE INVENTION

Electronic security systems are known for preventing unauthorized removal of articles from a zone under protection. Such systems are especially suitable for use in retail stores to prevent pilferage of articles and to minimize considerable losses occasioned by shoplifting. A particularly effective system is described in U.S. Pat. No. 3,810,147 and copending application Ser. No. 262,465, filed June 14, 1972, now U.S. Pat. No. 3,863,244 wherein a multi-frequency resonant tag having different frequencies for detection and deactivation is attached to articles of merchandise. The resonant tag circuit is operative at a first frequency to permit detection of tag presence in a protected zone by electromagnetic interrogation thereof and is operative at a second frequency to permit deactivation thereof by an applied electromagnetic field which destroys the resonant property of the circuit at its detection frequency. In order to prevent false alarms occasioned by the detection of spurious signals not originating from the presence of a resonant tag in a protected zone, it is necessary to distinguish true signals from noise in circumstances where the noise level may be greater in amplitude than the expected signals.

Copending application Ser. No. 262,465 describes signal discrimination circuitry which provides an output signal in response to received signals of predetermined amplitude, pulse width, pulse spacing, polarity and sequence, such that output pulses are provided only in response to true signals received from a resonant tag in the protected zone. These output pulses are in turn applied to noise rejection circuitry which responds to a predetermined pulse repetition rate for actuation of an alarm or other output utilization apparatus. Copending application Ser. No. 389,728, filed Aug. 20, 1973, now U.S. Pat. No. 3,828,337, describes particularly effective noise rejection circuitry which may be employed in an electronic security system. The present invention represents a refinement of the apparatus disclosed in copending application Ser. No. 262,465 and may be employed in an electronic security system in conjunction with the noise rejection circuitry described in copending application Ser. No. 389,728.

SUMMARY OF THE INVENTION

According to the invention, real time signal detection circuitry suitable for detection in a high noise environment of repetitive or non-repetitive signals such as signals received from a resonant tag in a protected zone is provided. Such circuitry finds application in an electronic security system operative in a high noise environment. Received signals are applied to serially enabled pulse width and height detectors, each of which responds to a particular component of an expected signal waveform. When the first pulse component of the expected signal waveform is received, a first threshold detector provides an output signal to a monostable multivibrator and sequences a counter. The monostable multivibrator defines a maximum time interval during which all the pulse components of the expected signal must be received and resets the counter at the expiration of this interval. The counter output is decoded to provide enable signals for successive threshold detectors in a desired time sequence and an alarm indication is provided when all pulse components of the expected signal are received in a predetermined time sequence.

Enhanced signal discrimination and protection against false alarms may be achieved by combining one or more signal processing modules, each having a plurality of threshold detectors interconnected as described above, in a real time signal discrimination system. The received signals are applied in parallel across two or more filters having different characteristics. The outputs of the signal processing modules are in turn applied to sequence a counter during a predetermined time interval defined by a multivibrator which is set by the first received signal processing module output. The signal processing modules are serially enabled by the decoded counter output in a time sequence and relationship which reflects the differing intrinsic time delays of the various filters. An alarm indicating output is provided by the counter only when a requisite number of outputs from signal processing modules are received within the predetermined time interval indicating that a real expected signal having expected characteristics when applied to a number of different filters has been received. The real time signal discrimination circuitry of the invention may be advantageously employed together with noise rejection circuitry such as that described in copending application Ser. No. 389,728 which distinguishes from noise a series of received signals of predetermined periodicity.

The signal discrimination circuitry of the invention may also be usefully employed in other types of security systems wherein signals of predetermined waveform configuration are received in a noisy environment.

DESCRIPTION OF THE DRAWING

The invention will be more fully understood from the following detailed description taken in conjunction with the accompanying drawing in which.

DETAILED DESCRIPTION OF THE INVENTION

Figure 1:
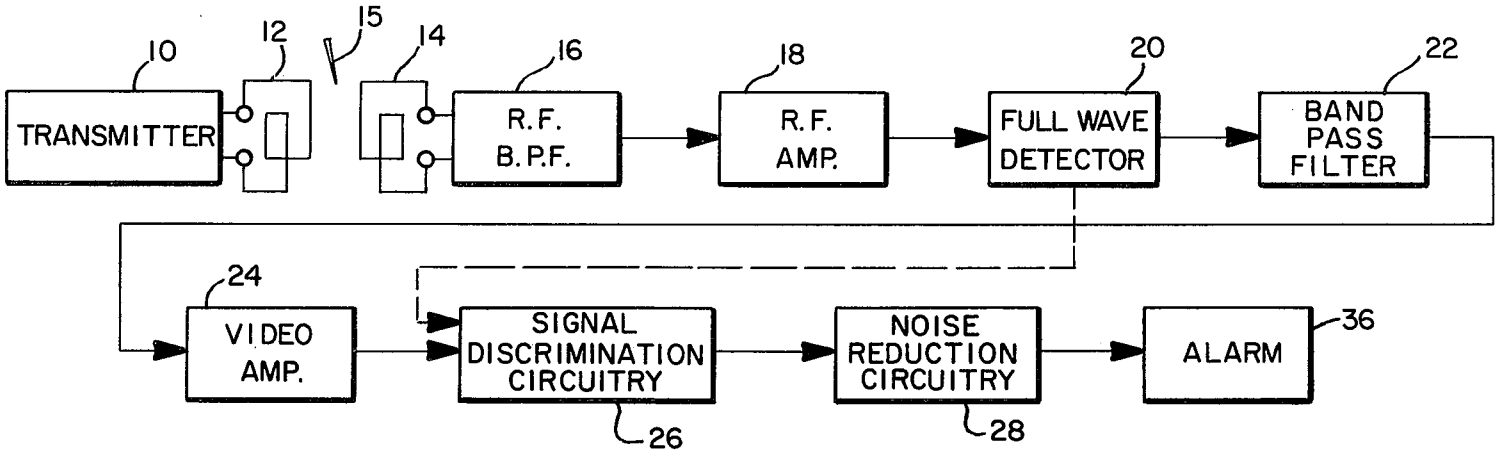
FIG. 1 is a block diagram representation of an electronic security system in which the invention may be advantageously employed.

The signal discrimination circuitry of the invention for discriminating a known non-repetitive or repetitive signal from a background of extremely high noise may be advantageously employed in an electronic security system such as that illustrated in FIG. 1 and which includes a transmitter 10 coupled to an antenna 12, typically a loop antenna operative to provide an electromagnetic field at a swept frequency within a predetermined zone to be controlled. A receiving antenna 14, also typically a loop antenna, receives energy radiated by antenna 12 and is arranged for sensing the presence of a resonant tag circuit 15 which is resonant at a frequency within the swept range at the controlled zone. Antenna 14 couples the received energy to an RF front-end which includes an RF bandpass filter 16 and an RF amplifier 18. The output of amplifier 18 is applied to a full wave detector 20, the output of which is in turn supplied to a bandpass filter 22 to eliminate much of the background noise. The output of filter 22 is applied via a video amplifier 24 to signal discrimination circuitry 26 which is the subject of the present invention. Alternatively, the output of full wave detector 20 may be supplied directly to signal discrimination circuitry 26.

The output of signal discrimination circuitry 26 may directly energize an alarm or alternatively may be applied through noise rejection circuitry 28 to energize an alarm 30. A detailed description of exemplary noise rejection circuitry suitable for use in an electronic security system is contained in copending application Ser. No. 389,728, filed Aug. 20, 1973.

Figures 2A, 2B, 2C, 2D, 2E, 2F, 2G:
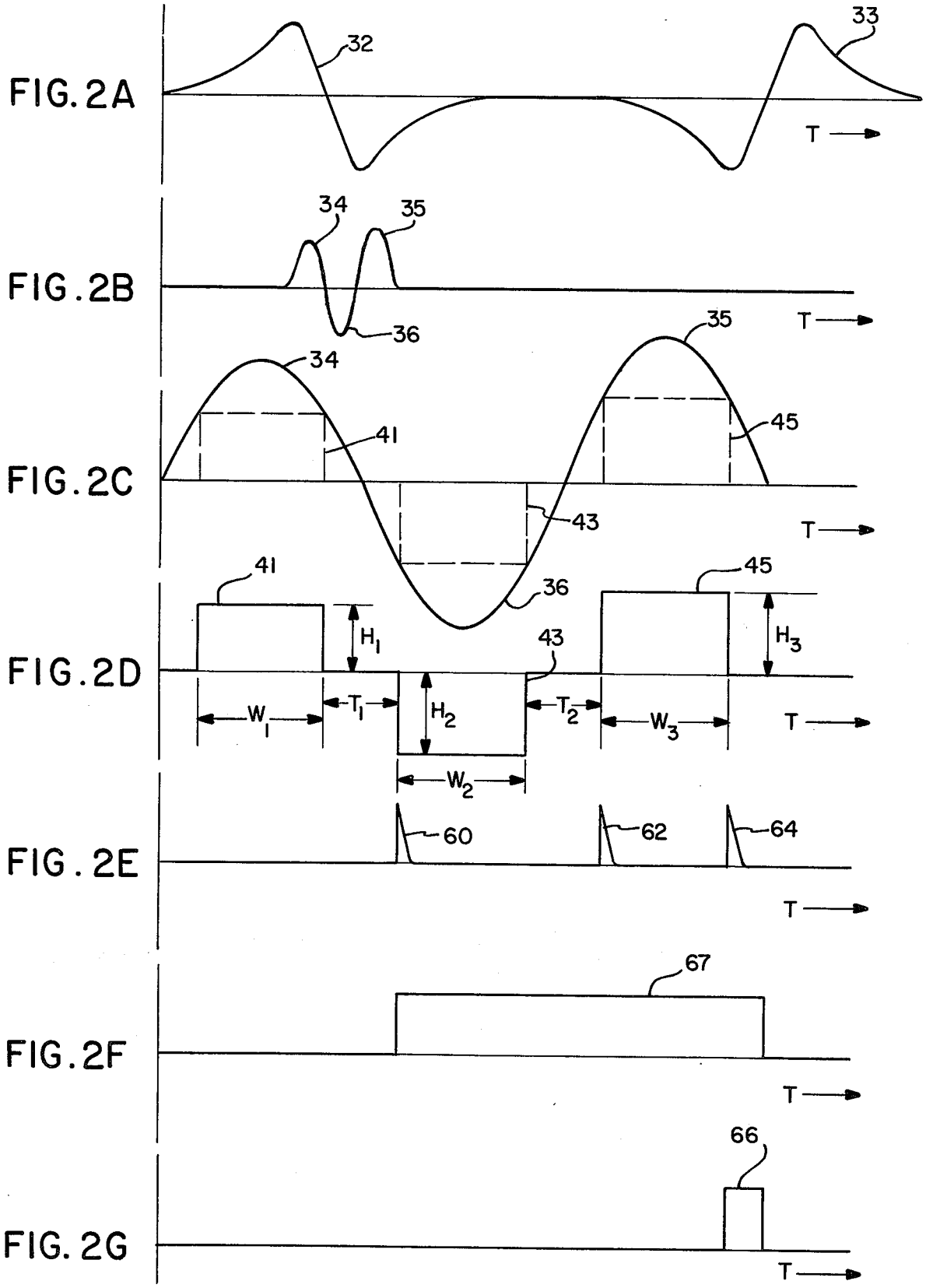
FIGS. 2A–2G are a plot of signal diagrams useful in illustrating the operation of the circuitry of the invention.

The circuitry of the invention is operative to sense an expected signal waveform having a predetermined characteristic and which can be approximated by a series of positive and/or negative pulses of specific heights and widths, whether or not repetitive. Referring to FIG. 2A, the waveform of a typical expected signal as received from full wave detector 20 (FIG. 1) appears as a pair of bipolar pulses 32 and 33 of opposite polarity indicating traversal of the resonant detection frequency of the tag circuit by the swept frequency transmitted signal.

In typical embodiment, the received signal shown in FIG. 2A is applied to a sharp cutoff high pass filter to remove spurious noise before being applied to the signal discrimination circuitry. A bandpass filter may be used instead of a high pass filter but is not required since the spectral content of the noise at higher frequencies is insufficient to require a high frequency cutoff. For purposes of illustration only pulse 32 will be considered to be the expected signal waveform. The actual expected waveform received in a particular embodiment may of course comprise a greater or lesser number of positive or negative pulses than the illustrated waveform, some of which may be identical and in any desired time relationship.

As seen in FIG. 2B, the positive to negative bipolar pulse 32 is resolved by the high pass filter into respective positive components 34 and 35 separated by negative pulse component 36. FIG. 2C depicts the waveform of FIG. 2B on an expanded scale for clarity of illustration. The waveform is processed according to the invention in accordance with predetermined height and width parameters as represented by the dotted rectangles 41, 43 and 45 in FIG. 2C and also in FIG. 2D. As shown in FIG. 2D the parameters representing the received uniform characteristics are defined in terms of pulse height, pulse width and the time relationship between the pulse components.

Figure 3:
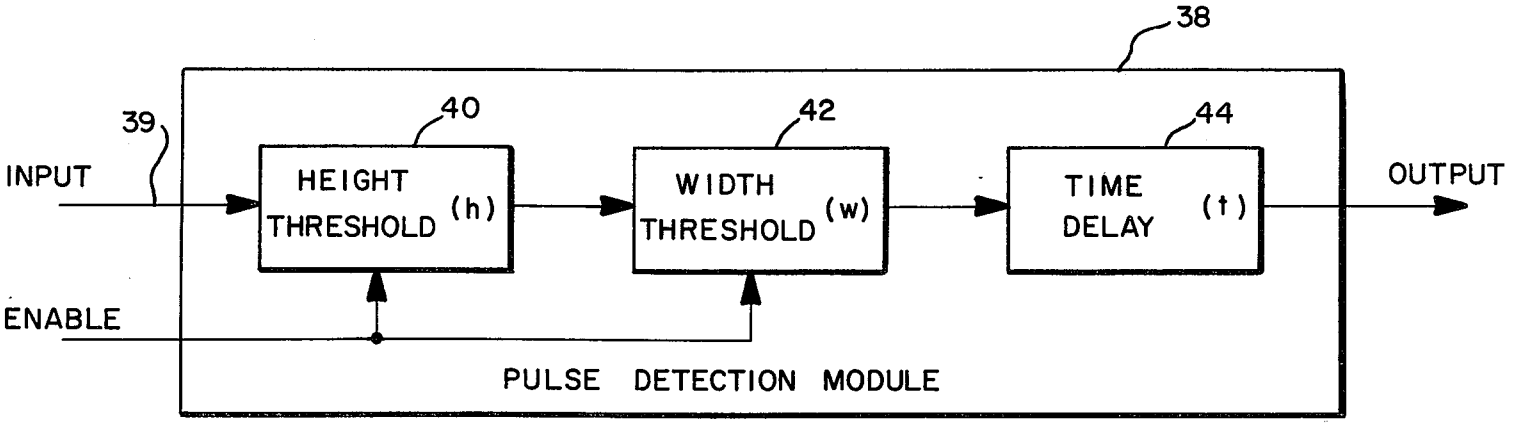
FIG. 3 is a block diagram representation of a controllable pulse detection module.

According to the invention, circuitry is provided for detecting received signals comprising pulses with predetermined minimum height and width parameters occurring in a desired sequence and time relationship and for providing an output indication of receipt thereof. Referring to FIG. 3, a controllable pulse detection module 38 is illustrated in which a filtered input signal such as that shown in FIGS. 2B and 2C and typically of a frequency in the video range is supplied to a height threshold detector 40, the output of which is in turn applied to a width threshold detector 42. Detectors 40 and 42 simultaneously receive an external enabling signal from circuitry which will be described hereinafter. While enabled by the enabling signal, the height threshold detector receiving an input signal of amplitude greater than a predetermined threshold level provides an output signal of a first signal level to width threshold detector 42. This output signal continues so long as the amplitude of the input exceeds the height threshold. Thus enabled by both the external enable signal and the output signal received from height threshold detector 40, width threshold detector 42 provides an output pulse indicating receipt of a signal of at least the minimum threshold amplitude for a minimum time duration. The output pulse from width threshold detector 42 may be applied through a selectable time delay circuit 44 to external utilization and sequencing circuitry which will hereinafter be described.

The amount of time delay t provided by delay circuit 44 in any given controllable pulse detection module may be selected to be zero or any greater value depending on the pulse configuration of the expected signal. The time delay $t$ is selected to be slightly less than the expected time separation T between detected digital threshold approximations of adjacent pulse components in order to take into account intrinsic time delays in the enabling circuitry. Clearly where no time delay is required, time delay circuitry 44 may be eliminated from the pulse detection module.

Alternative embodiments of the controllable pulse detection module 38 may also be employed as where output signals from a height and width threshold are ANDed and then applied to time delay 44 as an output pulse.

In a preferred embodiment of the invention which provides detection of repetitive or non-repetitive signals having digital pulse approximations of differing parameters, it is desirable to provide a plurality of controllable pulse detection modules where each module is matched to the height and width parameters of at least one predetermined component of the expected input signal. The controllable pulse detection modules are arranged for sequenced operation to provide detection of the various waveform components of the expected signal in a predetermined sequence and time relationship. It is appreciated that a pulse detection module may be used more than once in a signal detecting sequence, as for example when two pulse components of an expected signal are identical in height, width and time delay from adjacent pulse components.

Figure 4:
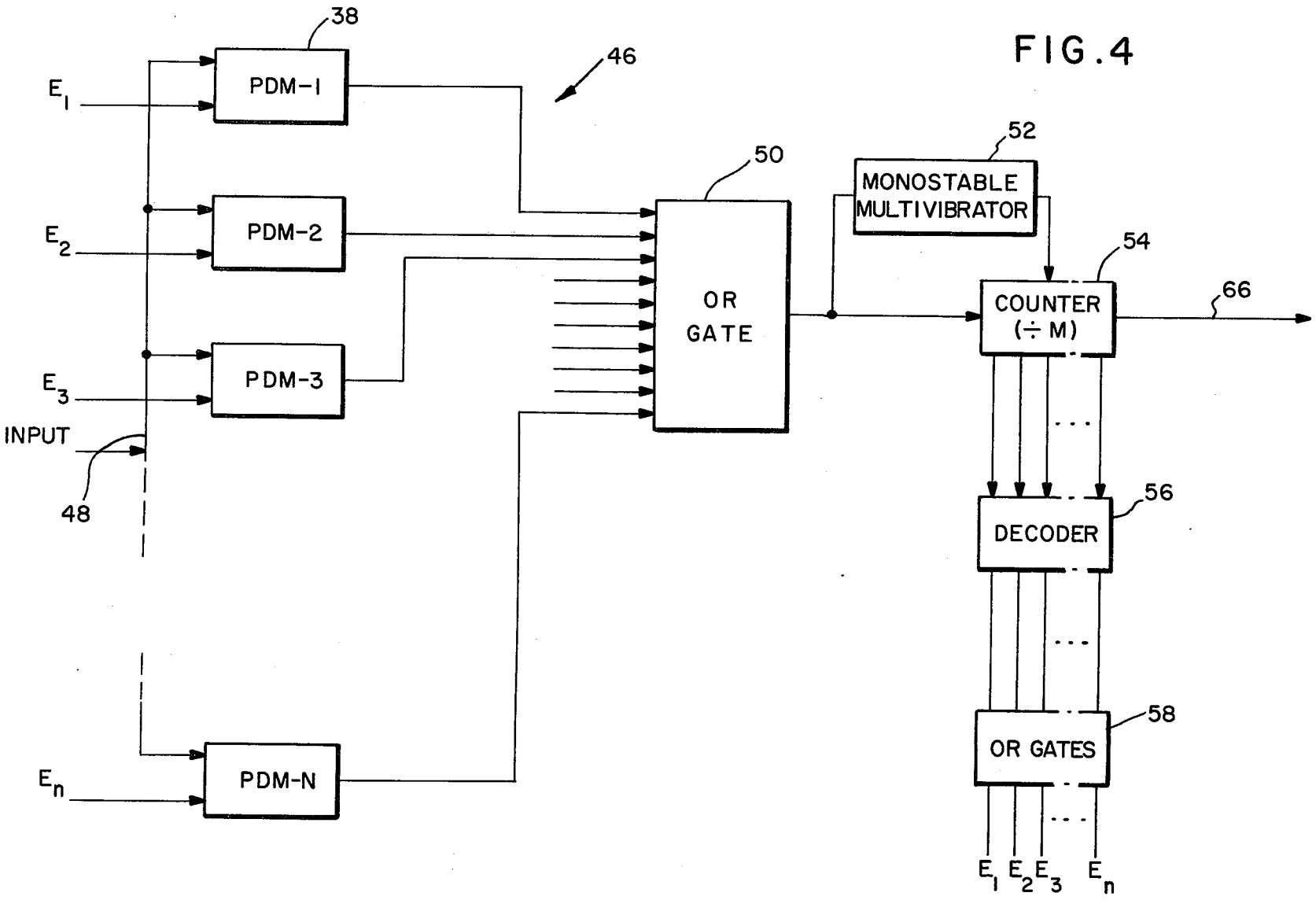
FIG. 4 is a block diagram representation of a signal processing module.

In FIG. 4 a signal processing module 46 comprising a plurality of controllable pulse detection modules 38 indicated as PDM-1—PDM-$n$ in sequenced arrangement is illustrated. An input signal supplied from amplifier 24 is applied via a bus 48 to the input of each pulse detection module 38. Each module 38 also receives a respective one of external enabling signals $E_1$–$E_n$ at its respective "enable" input. The output pulses from modules 38 are applied through an OR gate 50 to a monostable multivibrator 52 and to a counter 54. Each output pulse from a module 38 via OR gate 50, advances counter 54 by one count. Monostable multivibrator 52 is in preferred embodiment non-retriggerable and provides an output pulse for resetting of counter 54 a predetermined time after being set by an initial signal from a module 38, thereby determining the maximum time period in which a requisite number of output pulses from modules 38, indicating detection of the respective pulse components of the expected signal, must be received in order to actuate an alarm. The time period specified by monostable multivibrator 52 in the illustrated embodiment is predetermined to be the sum of the widths of the pulse components of the expected signal following the first received component thereof together with the expected time separation therebetween.

Counter 54 is a standard binary counter providing a multiple bit parallel output to a decoder 56. The outputs of decoder 56 are supplied to the various pulse detection modules 38 via an OR gate 58 as enabling signals $E_1$–$E_n$. These enabling signals, which represent the decoded counter output, are employed to enable a specific pulse detection module in the desired time sequence.

In operation, using as an exemplary expected signal that illustrated in FIGS. 2B and 2C, the sequence would be as follows. Referring to FIGS. 2D, 2E, 2F and 2G, at a time just after an output pulse from monostable multivibrator 52 has reset counter 54, pulse detection module 38 (PDM-1) is enabled by an enable signal $E_1$. Upon detection of an input signal component of requisite height $H_1$ and width $W_1$ and after a predetermined time $t_1$ specified by time delay 44 to correspond to the time interval $T_1$ between first and second expected pulse components, module PDM-1 provides an output pulse 60 through OR gate 50 which sequences counter 54 by one count and sets multivibrator 52 for determining the maximum time interval for detection of an entire expected signal. The new state of counter 54 is decoded by decoder 56, resulting in the termination of enable signal $E_1$ and the provision of an enable signal $E_2$ to a second module PDM-2 which is set to detect a second expected pulse component having height $H_2$ and width $W_2$. Upon detection by module PDM-2 of a pulse component having the requisite height and width parameters, and after a time delay $t_2$ determined by time delay 44 of module PDM-2, and corresponding to the time separation $T_2$ between the second and third expected pulse components, an output pulse 62 is provided by module PDM-2 through OR gate 50 for further sequencing of counter 54. In the preferred embodiment, this second pulse and any subsequent pulses prior to counter reset do not reset multivibrator 52. The decoded newly sequenced counter output in turn terminates the enable signal $E_2$ to module PDM-2 and enables a further pulse detection module PDM-3.

It is seen that modules 38 are sequentially enabled in a predetermined order until one of two events occurs. Either all of the expected signal components are received prior to reset of counter 54 and an alarm activating output signal 66 is provided by the counter, or counter 54 is reset before all of the expected pulse components have been received. In the latter case, the counter is reset to its initial state and module PDM-1 is again enabled to begin the detection cycle. In the former case, when the last expected pulse component is detected and module PDM-n provides an output signal to sequence counter 54, counter 54 provides an output indication to an alarm or to further processing circuitry as will hereinafter be described. Counter 54 is automatically reset at the expiration of the timing cycle of multivibrator 52. Alternatively, counter 54 could be reset together with monostable multivibrator 52 by the alarm activating output signal or by a signal derived therefrom.

In the exemplary case herein described as illustrated in FIG. 2 where the expected signal comprises three pulse components, module PDM-3, which detects the last in the series of pulse components, provides substantially no time delay. Thus, immediately upon detection of pulse component 35, module PDM-3 provides an output pulse 64 (FIG. 2E) which sequences counter 54 causing it to provide an alarm activating output signal 66 (FIG. 2G) during the time period 67 determined by multivibrator 52 (FIG. 2F).

It is apparent that if, and only if, pulse components of predetermined parameters are detected in a predetermined sequence and in predetermined respective time relationship by the pulse detection modules, will the counter advance to the proper count for provision of an alarm activating output signal before it is reset by multivibrator 52.

The module shown in FIG. 4 in its simplest embodiment can include one pulse detection module 38 and a single stage counter 54 operative to detect two identical sequential pulses in a given time relationship.

Figure 5:
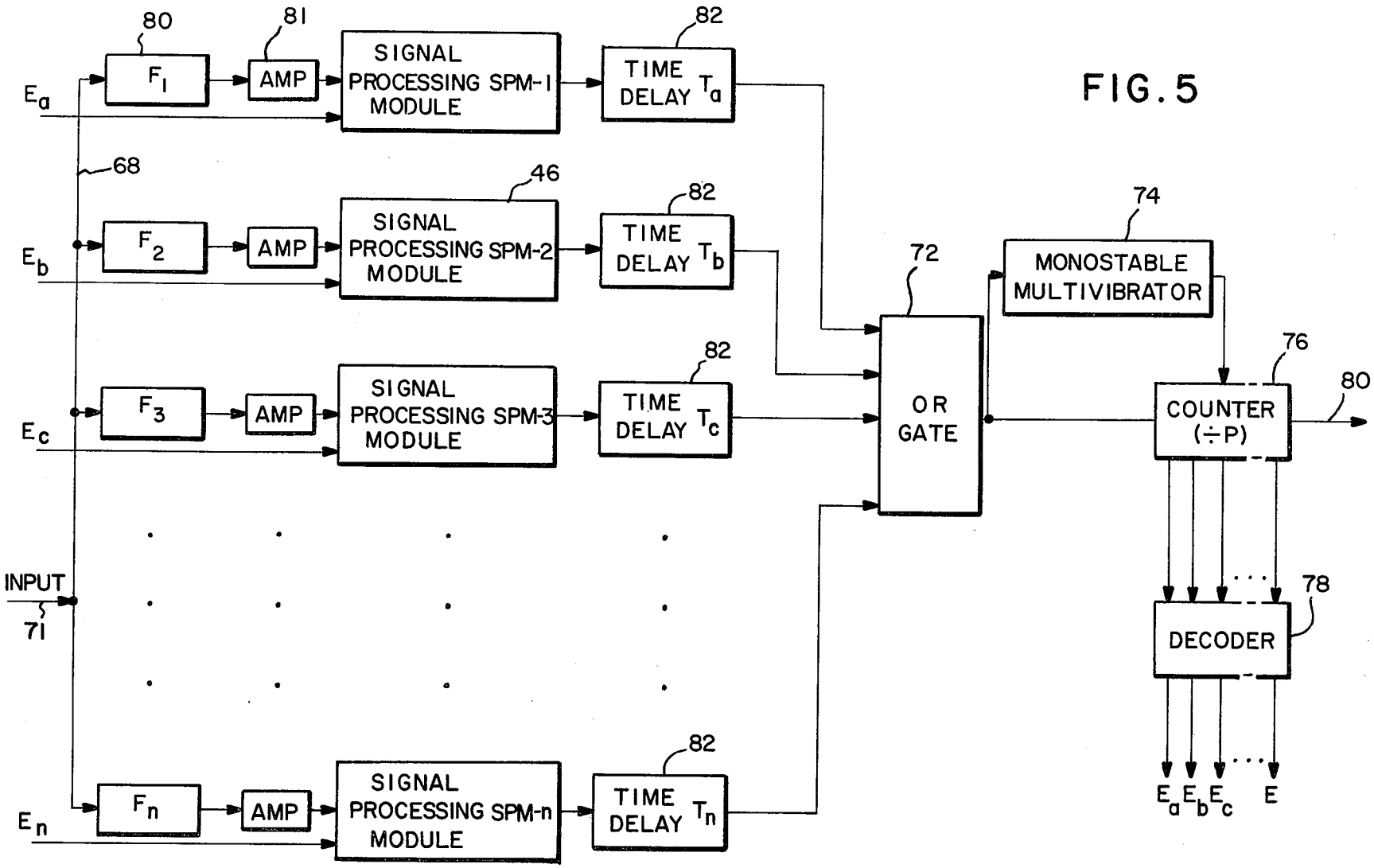
FIG. 5 is a block diagram representation of the real time signal discrimination system of the invention.

In a preferred embodiment of the invention, one or more signal processing modules 46 are incorporated in a real time signal discrimination system as illustrated in FIG. 5.

The invention provides a system for correlating in real time the receipt of output indications from a plurality of signal processing modules each receiving differently filtered signals. The different spectral versions of the received signal are correlated to provide a high level of discrimination between a received signal of expected form and spurious signals. Each of the modules 46 provides an output signal when the filtered version of the received signal applied thereto meets the predetermined signal criteria for the module. Spurious signals which may resemble one filtered version of the expected signal will not generally fulfill the predetermined signal criteria of all of the modules 46 and will not provide spurious alarm indication.

A received signal from full wave detector 24 (FIG. 1) is applied to a plurality of signal processing modules 46 (SPM-1-SPM-n) through respective filters 80 ($F_1$–$F_n$), typically operative at video frequencies. The filtered signals may first be amplified by respective amplifiers 81 before being applied to modules 46. The output signals from each of the filters 80 contain differing pulse components and consequently each signal processing module 46 associated with a particular filter is programmed to detect the signal characteristics associated with that particular filter. Since each type of filter may or may not also operate with a different time delay, the outputs of the various signal processing modules may generate coincident output pulses. In order to prevent the output signals of various signal processing modules from overlapping, and thus resulting in miscounting by counter 76, each signal processing module output is applied to a corresponding delay circuit 82 ($T_a$–$T_n$) to achieve proper time separation of the signal processing module outputs. The time delayed output is applied through OR gate 72 to a nonretriggerable monostable multivibrator 74 and counter 76 in an arrangement similar to that employed in the circuitry of the modules 46 and shown in FIG. 4. The multivibrator 74 is set by the first pulse in a series applied through OR gate 72 and remains in the set state for a predetermined time interval corresponding to the expected time interval within which output signals from all the signal processing modules SPM-1—SPM-n are expected in the presence of an expected signal. Multivibrator 74 resets counter 76 at the end of this predetermined period. The output of counter 76 is decoded by decoder 78 and the individual output channels from the decoder are applied as enable signals $E_a$–$E_n$ to the respective modules 46.

In the exemplary mode of operation where an input signal 71 is applied along a bus 68 to a plurality of signal processing modules SPM-1—SPM-n via respective filters $F_1$–$F_n$, at a time when counter 76 is set to its initial state, module SPM-1 is enabled by an enable signal $E_a$. Upon detection of an expected signal, module SPM-1 applies an output signal to a time delay circuit $T_a$ which, after a predetermined interval, supplies a signal through OR gate 72 to set multivibrator 74 and to sequence counter 76. The output of counter 76 is decoded by decoder 78. Upon receipt of the first output pulse from counter 76 the enable signal $E_a$ is terminated and an enable signal $E_b$ is produced to activate signal processing module SPM-2. Module SPM-2, upon detecting an expected signal through filter $F_2$, provides an output signal which is delayed for a predetermined interval $T_b$ and applied through OR gate 72 to sequence counter 76. The decoded output of counter 76 terminates enable signal $E_b$ and enables further signal processing modules in a similar manner as described.

Monostable multivibrator 74 defines a maximum time interval during which all the requisite output pulses must be received by counter 76 from modules 46 in order for alarm actuation to occur. The time interval defined by multivibrator 74 is not necessarily related to the time duration of the expected signal itself but rather defines a time interval within which the series of signal processing modules, each supplied with an input signal through a different filter and separately enabled, can be expected to receive an expected signal. If a requisite number of output signals are received at counter 76 before it is reset by monostable multivibrator 74, an alarm actuating output signal 80 is applied directly to an alarm or to further signal processing circuitry such as noise rejection circuitry described in copending application Ser. No. 389,728. Otherwise, counter 76 is reset and no alarm indication is provided.

The signal discrimination system described above and shown in FIG. 5 is a preferred embodiment of a system correlating the outputs of a plurality of signal processing modules 46 each receiving a differently filtered signal. Correlation circuitry different from that described can also be used. For example, OR gate 72, multivibrator 74, counter 76 and decoder 78 may be replaced by an AND gate to provide an output indication of coincidence.

The real time signal discrimination system of the invention provides extremely sharp signal discrimination without the use of video delay lines and is especially suitable for detection of non-repetitive signals in real time. This system can be easily programmed to detect any selected type of signal which consists of a set of pulses of predetermined polarity, height and width in a desired time and sequence relationship.

While a preferred embodiment of the present invention has been described in detail, it will occur to those skilled in the art that modifications and alternative implementations can be made without departing from the spirit of the invention. Accordingly, it is intended to limit the scope of the invention only as indicated in the following claims.

What is claimed is:

1. For use in an electronic security system which includes means for providing in a surveillance zone an electromagnetic field of a frequency which is swept within a predetermined range, and means for detecting the presence of a resonant tag circuit having a frequency within said range, circuitry for discriminating between signals indicating the presence of a valid tag circuit in said surveillance zone and spurious signals, said circuitry comprising:

means for receiving expected signals having a plurality of pulse components of predetermined parameters occurring in a predetermined sequence and time relationship and representative of detection of said tag circuit within said surveillance zone;

at least one controllable pulse threshold detector indicating detection of a pulse component having predetermined amplitude and width parameters;

means for serially enabling said at least one controllable pulse threshold detector in a predetermined sequence and time relationship;

means for defining a predetermined time interval for detection of a real signal in response to the detection of a first pulse component thereof;

means operative in response to detection of all of the pulse components comprising the expected signal in predetermined time sequence and within the predetermined time interval to provide an alarm indication; and means for resetting said circuitry at the end of said predetermined time interval.

2. A circuit according to claim 1 wherein said means for defining said predetermined time interval comprises a monostable multivibrator triggered by a first received output pulse from said at least one controllable pulse threshold detector.

3. A circuit according to claim 1 wherein said controllable pulse threshold detector comprises a height threshold detector receiving said received signal and operative when enabled to provide an output signal indicating concurrent receipt of a pulse having pulse height exceeding a predetermined threshold; and a width threshold detector receiving the output signal from said height threshold detector and operative when enabled to provide an output signal in response to receipt of said output signal from said height threshold for a predetermined period indicating a predetermined pulse width at said height threshold.

4. A circuit according to claim 3 wherein said controllable pulse threshold detector includes time delay means operative in response to said width threshold output to provide an output signal after a predetermined time interval.

5. A circuit according to claim 1 wherein said means for serially enabling said at least one pulse threshold detector comprises a counter which receives output pulses from said at least one pulse threshold detector and decoding means operative in response to the outputs from said counter to provide enable signals to said at least one pulse threshold detector.

6. For use in an electronic security system which includes means for providing in a surveillance zone an electromagnetic field of a frequency which is swept within a predetermined range, and means for detecting the presence of a resonant tag circuit having a frequency within said range, circuitry for discriminating between signals indicating the presence of a valid tag circuit in said surveillance zone and spurious signals, said circuitry comprising:

means for receiving signals derived from detection of a tag circuit within said surveillance zone including real signals indicating tag presence and noise;

at least first and second filter means each receiving said received signal and providing a filtered output;

at least first and second signal processing means each receiving a respective filtered output from said at least first and second filter means and operative when enabled to provide an output signal in response to detection of a predetermined respective signal waveform;

means for guaranteeing non-coincidence of the output signals of said at least first and second signal processing means;

means for defining a maximum time interval for receipt of output signals from said signal processing means indicating receipt of a real expected signal, said time interval beginning upon receipt of a first output signal from said at least first and second signal processing means;

means operative upon receipt of a predetermined number of output pulses within said predetermined maximum time interval to provide an alarm indication;

means for enabling said at least first and second signal processing means in a predetermined time sequence; and means for resetting said circuitry upon completion of said predetermined time interval.

7. For use in an electronic security system, circuitry for discriminating between signals indicating the presence of a predetermined object in a surveillance zone and spurious signals, said circuitry comprising:

means for receiving expected signals having a plurality of pulse components of predetermined parameters occurring in a predetermined sequence and time relationship and representative of detection of said object within said surveillance zone;

at least one controllable pulse threshold detector indicating detection of a pulse component having predetermined amplitude and width parameters;

means for serially enabling said at least one controllable pulse threshold detector in a predetermined sequence and time relationship;

means for defining a predetermined time interval for detection of a real signal in response to the detection of a first pulse component thereof;

means operative in response to detection of all of the pulse components comprising the expected signal in predetermined time sequence and within the predetermined time interval to provide an alarm indication; and means for resetting said circuitry at the end of said predetermined time interval.

8. For use in an electronic security system circuitry for discriminating between signals indicating the presence of a predetermined object in a surveillance zone and spurious signals, said circuitry comprising:

means for receiving signals derived from detection of an object within said surveillance zone including real signals indicating object presence and noise;

at least first and second filter means each receiving said received signal and providing a filtered output;

at least first and second signal processing means each receiving a respective filtered output from said at least first and second filter means and operative when enabled to provide an output signal in response to detection of a predetermined respective signal waveform;

means for guaranteeing non-coincidence of the output signals of said at least first and second signal processing means;

means for defining a maximum time interval for receipt of output signals from said signal processing means indicating receipt of a real expected signal, said time interval beginning upon receipt of a first output signal from said at least first and second signal processing means;

means operative upon receipt of a predetermined number of output pulses within said predetermined maximum time interval to provide an alarm indication;

means for enabling said at least first and second signal processing means a predetermined time sequence; and means for resetting said circuitry upon completion of said predetermined time interval.

* * * * *